US010811833B2

(12) United States Patent
Crocco et al.

(10) Patent No.: US 10,811,833 B2
(45) **Date of Patent: *Oct. 20, 2020**

(54) WIRE INSERTION APPARATUS AND METHOD

(71) Applicant: The Boeing Company, Chicago, IL (US)

(72) Inventors: James R. Crocco, Gilbert, AZ (US); Stephen Doyle, Mesa, AZ (US); Frederick C. Edman, Mesa, AZ (US); Jason Gerald DeStories, Mesa, AZ (US)

(73) Assignee: The Boeing Company, Chicago, IL (US)

( * ) Notice: Subject to any disclaimer, the term of this patent is extended or adjusted under 35 U.S.C. 154(b) by 136 days.

This patent is subject to a terminal disclaimer.

(21) Appl. No.: 15/965,167

(22) Filed: Apr. 27, 2018

(65) Prior Publication Data

US 2018/0248329 A1 Aug. 30, 2018

Related U.S. Application Data

(63) Continuation of application No. 14/807,247, filed on Jul. 23, 2015, now Pat. No. 9,985,406.

(51) Int. Cl.
*H01R 43/20* (2006.01)

(52) U.S. Cl.
CPC ..... *H01R 43/20* (2013.01)

(58) Field of Classification Search
CPC ..... G02B 6/40; H01B 13/00; H01B 13/012; H01B 13/012019; H01R 43/20
See application file for complete search history.

(56) References Cited

U.S. PATENT DOCUMENTS

| | | | |
|---|---|---|---|
| 4,711,025 | A | 12/1987 | DeSanto |
| 4,727,637 | A | 3/1988 | Buckwitz et al. |
| 4,951,385 | A | 8/1990 | Desanto |
| 5,198,983 | A | 3/1993 | Blake et al. |
| 6,272,387 | B1 | 8/2001 | Yoon |

(Continued)

FOREIGN PATENT DOCUMENTS

| | | | |
|---|---|---|---|
| JP | 2001195153 | A * | 7/2001 |
| WO | 2014073224 | A1 * | 5/2014 |
| WO | 2014073225 | A1 * | 5/2014 |

*Primary Examiner* — Carl J Arbes
(74) *Attorney, Agent, or Firm* — Sage Patent Group

(57) ABSTRACT

A system for assisting in the assembly of a cable harness may include a wire insertion apparatus that includes a frame that defines a connector mounting location; a projector mount attached to the frame and positioned so that a projector held in the projector mount projects graphical information onto a connector held by the mounting location; and the projector. The system may also include a computer device in communication with the projector and comprising a module configured for: projecting, via the projector, a plurality of alignment dots onto the connector; moving the alignment dots based on a first user input; receiving a second user input that the alignment dots are aligned and, based on the second user input, determining a position and orientation of the connector; and illuminating, via the projector, one or more pin locations of the connector based on the position and orientation of the connector.

25 Claims, 8 Drawing Sheets

(56) References Cited

U.S. PATENT DOCUMENTS

| | | | | |
|---|---|---|---|---|
| 6,793,401 | B2 * | 9/2004 | Daniel | G02B 6/3885 29/721 |
| 7,270,565 | B2 | 9/2007 | Kamata et al. | |
| 8,099,857 | B2 | 1/2012 | Shelley et al. | |
| 8,601,675 | B2 | 12/2013 | Shelley et al. | |
| 9,589,390 | B2 | 3/2017 | DeStories et al. | |
| 9,985,406 | B2 * | 5/2018 | Crocco | H01R 43/20 |
| 2006/0185158 | A1 | 8/2006 | Kuhn | |
| 2007/0277372 | A1 | 12/2007 | Aida et al. | |
| 2009/0199396 | A1 | 8/2009 | Shelley et al. | |
| 2014/0267936 | A1 | 9/2014 | Kahle | |

* cited by examiner

WIRE INSERTION APPARATUS AND METHOD

CROSS-REFERENCE TO RELATED APPLICATION

The present application is a continuation of U.S. patent application Ser. No. 14/807,247 for "WIRE INSERTION APPARATUS AND METHOD" (filed Jul. 23, 2015), which published as U.S. Patent Application Publication No. 2017/0025808, and which issued as U.S. Pat. No. 9,985,406 on May 29, 2018, and which is hereby incorporated by reference in its entirety.

BACKGROUND

Assembling a cable harness is a difficult and labor intensive process. In this regard, dozens of wires may need to be manually inserted into a connector. Existing systems for assisting the assembly of cable harnesses mechanically move a laser beam to illuminate one cavity of a connector to facilitate wire insertion. That said, a need exists for an improved system for assisting the assembly of cable harnesses.

SUMMARY

In one aspect, the present disclosure embraces a system for assisting the assembly of a cable harness.

In one embodiment, the system includes a wire insertion apparatus that includes a frame, the frame defining a connector mounting location; a projector mount attached to the frame, the projector mount being positioned so that a projector held in the projector mount projects graphical information onto a connector held by the mounting location; and the projector. The projector is typically configure to project a plurality of alignment dots onto the connector for use in aligning the connector to establish the position and orientation of the connector, and configured to illuminate one or more pin locations of the connector based on the position and orientation of the connector.

In some embodiments and in combination with any of the above embodiments, the wire insertion apparatus comprises a clamp for releasably securing the connector in the connector mounting location.

In some embodiments and in combination with any of the above embodiments, the frame defines a flat surface adjacent to the connector mounting location, and the projector mount is positioned so that the projector projects graphical information onto the flat surface.

In some embodiments and in combination with any of the above embodiments, the system includes a computer device in communication with the projector and comprising a processor, a memory, and a module stored in the memory, executable by the processor and configured to control the projector for projecting the plurality of alignment dots onto the connector, moving the alignment dots based on a first user input, receiving a second user input that the alignment dots are aligned and determining a position and orientation of the connector, and controlling the projector to illuminate the one or more pin locations of the connector based on the position and orientation of the connector.

In some embodiments and in combination with any of the above embodiments, the module is configured for projecting, via the projector, a graphical user interface onto a flat surface on the frame adjacent to the connector mounting location.

In some embodiments and in combination with any of the above embodiments, the first user input and the second user input are received via the graphical user interface.

In some embodiments and in combination with any of the above embodiments, illuminating one or more pin locations of the connector comprises projecting graphical information regarding the one or more pin locations onto the flat surface.

In some embodiments and in combination with any of the above embodiments, determining the position and orientation of the connector is based on determining the coordinates of the alignment dots.

In some embodiments and in combination with any of the above embodiments, the module is configured for receiving a connector schematic, the connector schematic defining coordinates for the one or more pin locations, and illuminating one or more pin locations of the connector comprises projecting, via the projector, an illumination dot onto each of the one or more pin locations based on (i) the position and orientation of the connector and (ii) the coordinates for the one or more pin locations defined in the connector schematic.

In some embodiments and in combination with any of the above embodiments, illuminating one or more pin locations of the connector comprises concurrently projecting, via the projector, a plurality of illumination dots, each illumination dot being projected onto one of a plurality of pin locations of the connector, wherein each of the plurality of illumination dots has a distinguishing characteristic.

In another aspect, the present disclosure embraces a method of inserting wire(s) into a connector. In one embodiment, the method includes: (i) providing a wire insertion apparatus, the wire insertion apparatus comprising: a frame, the frame defining a connector mounting location; and a projector mount attached to the frame, the projector mount being positioned so that a projector held in the projector mount projects graphical information onto the connector when the connector held by the mounting location; (ii) mounting the projector (140) to the projector mount; (iii) mounting the connector to the connector mounting location; (iv) projecting, via the projector, a plurality of alignment dots onto the connector; (v) moving, via a computer processor, the alignment dots based on a first user input; (vi) receiving, via a computer processor, a second user input that the alignment dots are aligned and, based on the second user input, determining, via a computer processor, a position and orientation of the connector; (vii) illuminating, via the projector, one or more pin locations of the connector based on the position and orientation of the connector; and (viii) inserting a wire into each of the one or more illuminated pin locations.

In yet another aspect, the present disclosure embraces a computer program product for assisting the assembly of a cable harness. In one embodiment, the computer program product comprises a non-transitory computer-readable storage medium having computer-executable instructions for: causing a projector to project a plurality of alignment dots onto the connector; moving the alignment dots based on a first user input; receiving a second user input that the alignment dots are aligned and, based on the second user input, determining a position and orientation of the connector; and causing the projector to illuminate one or more pin locations of the connector based on the position and orientation of the connector. In a particular embodiment, the non-transitory computer-readable storage medium has computer-executable instructions for causing the projector to project a graphical user interface onto a flat surface adjacent to the connector, wherein the first user input and the second user input are received via the graphical user interface.

BRIEF DESCRIPTION OF THE DRAWINGS

The present disclosure is further described in the detailed description which follows in reference to the noted plurality of drawings by way of non-limiting examples of embodiments of the present disclosure in which like reference numerals represent similar parts throughout the several views of the drawings and wherein.

DETAILED DESCRIPTION

Figure 1:
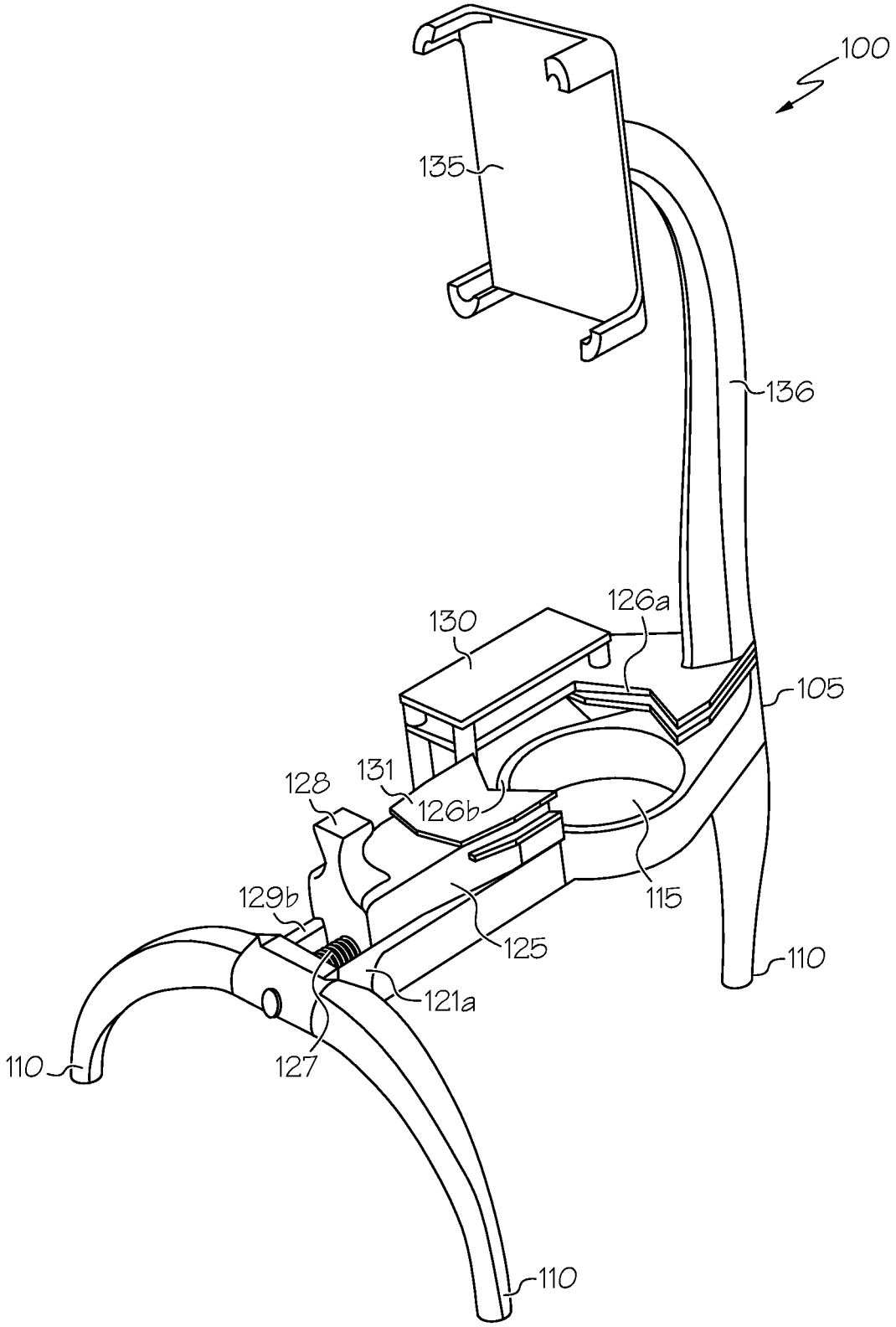
FIG. 1 depicts an exemplary wire insertion apparatus in accordance with an embodiment of the present disclosure.

The embodiments described herein may be a system, a method, and/or a computer program product. The computer program product may include a computer readable storage medium (or media) having computer readable program instructions thereon for causing a processor to carry out aspects of the present disclosure.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present disclosure may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present disclosure.

Aspects of the present disclosure are described herein with reference to flowchart illustrations and/or block diagrams of methods, apparatus (systems), and computer program products according to embodiments of the disclosure. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

In one aspect, the present disclosure embraces a system for assisting the assembly of a cable harness. The system typically includes a wire insertion apparatus that is configure to secure a connector and display graphical information on the connector, which can be used to facilitate wire insertion.

Figure 2:
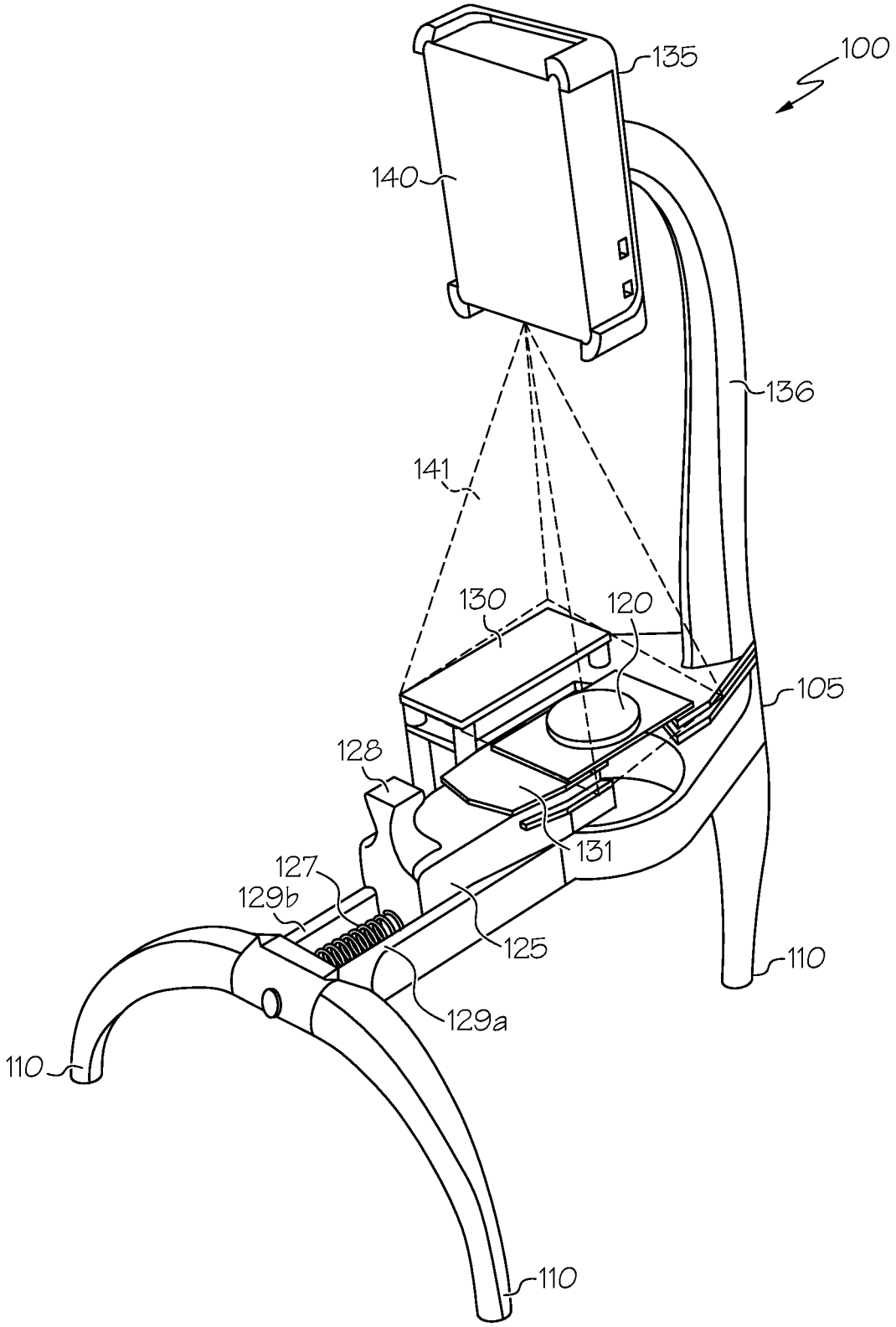
FIG. 2 depicts an exemplary wire insertion apparatus with a mounted projector and secured connector in accordance with an embodiment of the present disclosure.

In this regard, FIGS. 1-2 depict any exemplary wire insertion apparatus 100 in accordance with an embodiment of the present disclosure. The wire insertion apparatus 100 includes a frame 105. The frame 105 typically defines a plurality of pedestals 110 for elevating the wire insertion apparatus 100 above a surface on which it is positioned. The frame 105 also typically defines an opening 115 or other mounting location for receiving a connector 120. The connector 120 may be any type of connector used in a cable harness, such as cable harnesses used in the aerospace industry. The frame 105, and other components of the wire insertion apparatus 100, may be formed from metal, a polymeric material, or any other suitable material(s).

A clamp 125 is typically used to secure the connector 120 in the opening 115. In this regard, the clamp 125 and the frame 105 typically define jaws 126*a* and 126*b* for holding the connector 120. A spring 127 may be used to bias the clamp 125 against the connector 120 when the connector 120 is positioned in the opening 115. The clamp 125 may include a grip 128 to allow a user to manipulate the clamp (e.g., so that the clamp may be inserted into the opening 115). As depicted in FIG. 1, the frame 105 typically defines rails 129*a* and 129*b* along which the clamp 125 may slide. By employing the clamp 125, connectors of different sizes can be held in the wire insertion apparatus 100. Although FIGS. 1-2 depict a clamp for securing a connector to the wire insertion apparatus 100, any other structure for mounting (e.g., releasably mounting) a connector to the wire insertion apparatus 100 may be employed.

The frame 105 typically defines a flat surface 130 upon which graphical information may be displayed. The flat surface 130 is typically positioned adjacent to the opening 115. In some embodiments, the clamp 125 may define a flat surface 131 upon which graphical information may also be displayed.

The wire insertion apparatus 100 typically includes a projector mount 135 in which a projector 140 may be mounted (e.g., releasably mounted). The mount 135 may be attached to the frame 105 via a mount arm 136. Any type of projector that may be mounted to the wire insertion apparatus 100 and used to project graphical information is within the scope of the present disclosure. In addition, any type of projector mount 135 that may be used to attach the projector 140 to the wire insertion apparatus 100 is within the scope of the present disclosure. As shown in FIG. 2, the projector mount 135 is typically positioned above the opening 115 and the flat surface 130 so that graphical information (represented by the light cone 141) projected from the projector 140 may be displayed (i) on the connector 120, when it is secured by the clamp 125, and (ii) on the flat surface 130 of the frame 105. Graphical information may also be projected onto the flat surface 131 of the clamp 125. A computing device is typically connected to the projector 140 to control the graphical information being projected.

Figure 3:
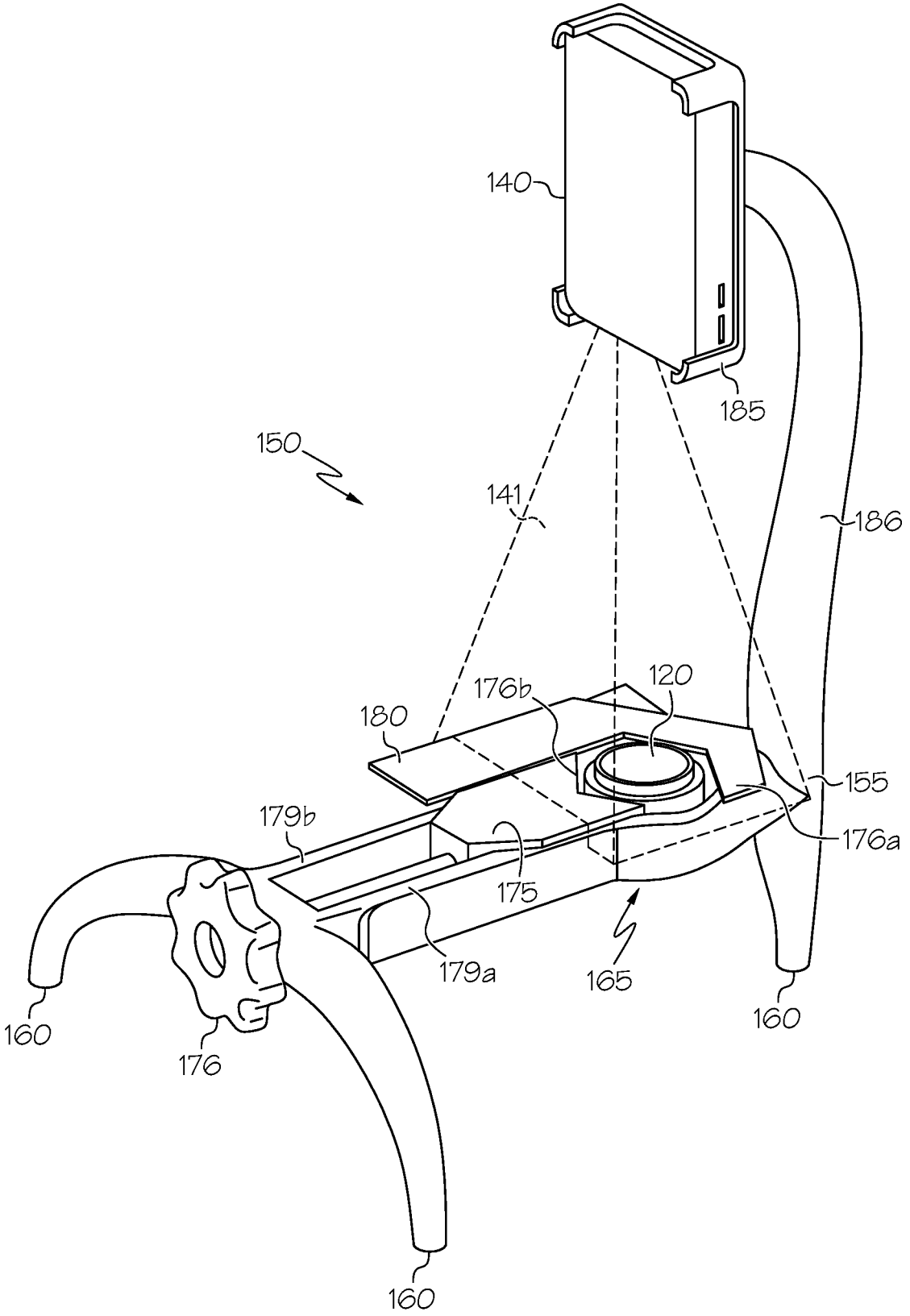
FIG. 3 depicts an exemplary wire insertion apparatus in accordance with another embodiment of the present disclosure.

FIG. 3 depicts an alternative wire insertion apparatus 150 in accordance with another embodiment of the present disclosure. Similar to the wire insertion apparatus depicted in FIGS. 1-2, the wire insertion apparatus 150 depicted in FIG. 3 includes a frame 155 that defines pedestals 160, an opening 165 for receiving the connector 120, and flat surface 180 upon which graphical information may be displayed. A clamp 175 may be used to secure the connector 120 in the opening 165. In this regard, the clamp 175 and the frame 155 typically define jaws 176*a* and 176*b* for holding the connector 120. The wire insertion apparatus 150 may include a screw (not shown) for biasing the clamp 175 against the connector 120 when it is positioned in the opening 165. The screw is typically connected to a knob 176 that may be turned to tighten or loosen the screw. The frame typically defines rails 179*a* and 179*b* along which the clamp 175 may slide.

A mount arm 186 may be used to position a projector mount 185 above the opening 165 and the flat surface 180 so that graphical information (represented by the light cone 141) from the projector 140 may be display on the connector 120 and on the flat surface 180 when the projector 140 is mounted to the projector mount 185 and the connector 120 is secured by the clamp 175. A computing device is typically connected to the projector 140 (e.g., via a wired or wireless connection) to control the graphical information being projected.

Figure 4:
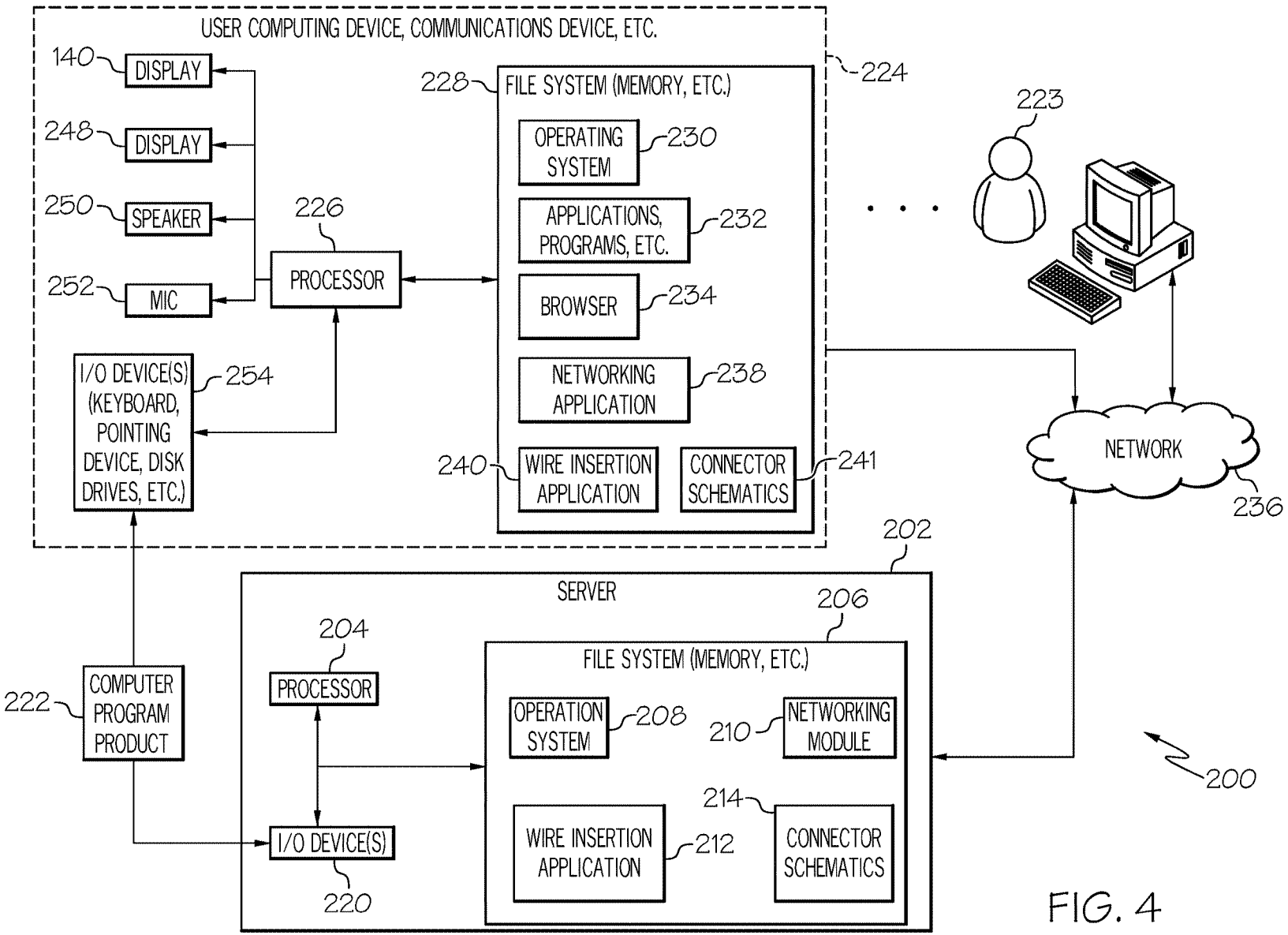
FIG. 4 is a block schematic diagram of an exemplary system for assisting the assembly of a cable harness in accordance with an embodiment of the present disclosure.

FIG. 4 is a block schematic diagram of an example of a system 200 for assisting the assembly of a cable harness in accordance with an embodiment of the present disclosure. The system 200 may include a computing device, such as a server 202 and/or a personal computing device 224. As described in more detailed herein, the server and/or personal computing device 224 may be configured to control the graphical information projected by the projector 140, thereby aiding a user in inserting wires into the connector 120.

The server 202 may be a server or similar processing device. The server 202 may include a processor 204 for controlling operation of the server 202 for performing functions, such as those described herein with respect to controlling the graphical information projected by the projector 140. The server 202 may also include a file system 206 or memory. An operating system 208, applications and other programs may be stored on the file system 206 for running or operating on the processor 204. A networking module 210 or system may also be stored on the file system 206 and may be compiled and run on the processor 204 to perform the function of allowing the server 202 to communicate with other devices similar to those described herein. The networking module 210 may be any type of online communications mechanism for online communications or conversations.

A wire insertion application 212 may also be stored on the file system 206. Aspects of the method 300 of FIG. 5 (described below) may be embodied in the wire insertion application 212 and may be performed by the processor 204 when the wire insertion application 212 is compiled and run on the processor 204. The wire insertion application 212 may operate in association with the networking module 210 and other types of communications media to perform the functions and operations associated with the method 300. In another embodiment, the wire insertion application 212 may be a component of the networking module 210 and may operate in association with the networking module 210 and other communications media.

Connector schematics 214 may also be stored on the file system 206. The connector schematics 214 may be used by the wire insertion application 212 to display information specific to type of connector being held by a wire insertion apparatus. In another embodiment, the connector schematics 214 may be a component of the networking module 210.

The server 202 may also include one or more input devices, output devices or combination input/output devices, collectively I/O devices 220. The I/O devices 220 may include, but are not necessarily limited to, a keyboard or keypad, pointing device, such as a mouse, disk drive and any other devices to permit a user to interface with and control operation of the server 202 and to communicate with other devices and systems. In one embodiment, the I/O devices 220 may include the projector 140. At least one of the I/O devices 220 may be a device to read a computer program product, such as computer program product 222. The computer program product 222 may be similar to that described in more detail herein. The networking module 210 and the wire insertion application 212 may be loaded on the file system 206 from a computer program product, such as computer program product 222.

A user 223 may use a personal computing device 224 or communications device independently or to access the server 202, networking module 210 or wire insertion application 212. The personal computing device 224 or communications device may be any sort of communications device, including a mobile or handheld computer or communications device. The personal computing device 224 may include a processor 226 to control operation of the personal computing device 224 and a file system 228, memory or similar data storage device. An operating system 230, applications 232 and other programs may be stored on the file system 228 for running or operating on the processor 226. A web or Internet browser 234 may also be stored on the file system 228 for accessing the server 202 via a network 236. The network 236 may be the Internet, an intranet or other private or proprietary network.

A networking application 238 for may also be stored on the file system 228 and operate on the processor 226 of the personal computing device 224.

In accordance with an embodiment, a wire insertion application 240 may also be stored on the file system 228. Aspects of the method 300 in FIG. 5 may be embodied and performed by the wire insertion application 240. In accordance with another embodiment, the wire insertion application 240 may be part of the networking application 238. Connector schematics 241 may also be stored on the file system 228.

The wire insertion application 240 operating on the personal computing device 224 may interface with or operate in conjunction with the wire insertion application 212 on the server 202 to perform the functions and operations described herein for assisting the assembly of a cable harness. Accordingly, the wire insertion application 240 operating on the personal computing device 224 may perform some of the functions and operations of the method 300 and the wire insertion application 212 operating on the server 202 may perform other functions of the method 300. Some embodiments of the present disclosure may include only the wire insertion application 212 operating on the server 202, and other embodiments may include only the wire insertion application 240 operating on the personal computing device 224. In some embodiment, the web or Internet browser 234 may interface with or operate in conjunction with the wire insertion application 212 on the server 202 to perform the functions and operations described herein for assisting the assembly of a cable harness.

The personal computing device 224 may also include a display 248, a speaker system 250, and a microphone 252 for voice communications. One or more user interfaces may be presented on the display 248 for controlling operation of the personal computing device 224 (e.g., for controlling operation of the networking application 240) and for performing the operations and functions described herein.

The personal computing device 224 may also include one or more input devices, output devices or combination input/output devices, collectively I/O devices 254. The I/O devices 254 may include a keyboard or keypad, pointing device, such as a mouse, disk drives and any other devices to permit a user, such as user 223, to interface with and control operation of the personal computing device 224 and to access networking application 240 and/or wire insertion application 212 on server 202. The I/O devices 254 may also include at least one device configured to read computer code from a computer program product, such as computer program product 222. In one embodiment, the I/O devices 254 may include the projector 140.

Figure 5:
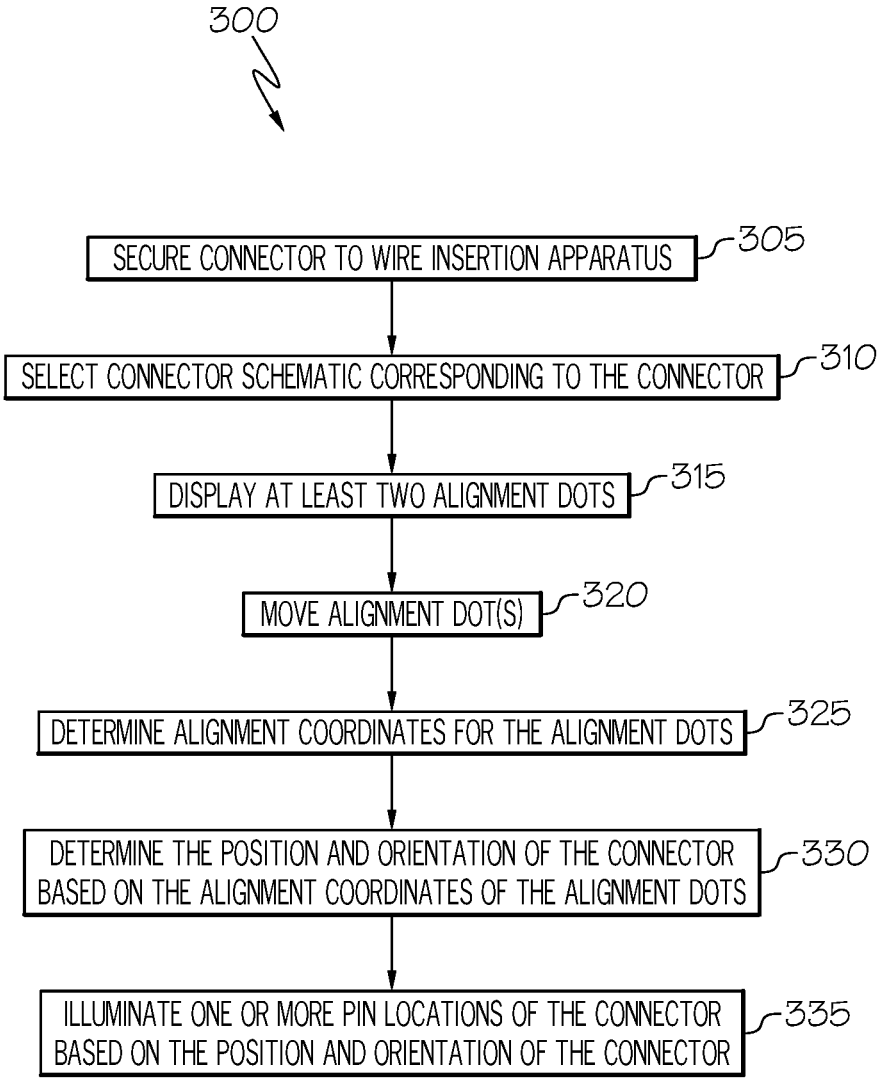
FIG. 5 depicts an exemplary method of using the system and wire insertion apparatus in accordance with an embodiment of the present disclosure.

FIG. 5 depicts a method 300 of inserting wires into a connector by using the system 200 and a wire insertion apparatus in accordance with the present disclosure.

At block 305, the connector 120 is secured or otherwise mounted (e.g., releasably mounted) to a wire insertion apparatus (e.g., a wire insertion apparatus 100 in accordance with FIGS. 1-2 or the wire insertion apparatus 150 in accordance with FIG. 3). In this regard, a user may slide or otherwise open the clamp of the wire insertion apparatus so that the connector 120 can be inserted. Thereafter, the user may allow the clamp to retract or may otherwise tighten the clamp so that the connector 120 is secured between the jaws (e.g., the jaws 126*a* and 126*b*) of the wire insertion apparatus.

Before or after mounting the connector 120 to the wire insertion apparatus, the projector 140 may be mounted to the mount of the wire insertion apparatus. In addition, the projector 140 may be connected (e.g., via a wired or wireless connection) to the personal computing device 224 and/or to the server 202.

At block 310, a connector schematic corresponding to the connector 120 is selected. For example, the user may use a wire insertion application of the personal computing device 224 and/or to the server 202 to select the connector schematic corresponding to the connector 120. Based on the user selection of the connector schematic, the personal computing device 224 and/or to the server 202 may retrieve the connector schematic.

Figure 6:
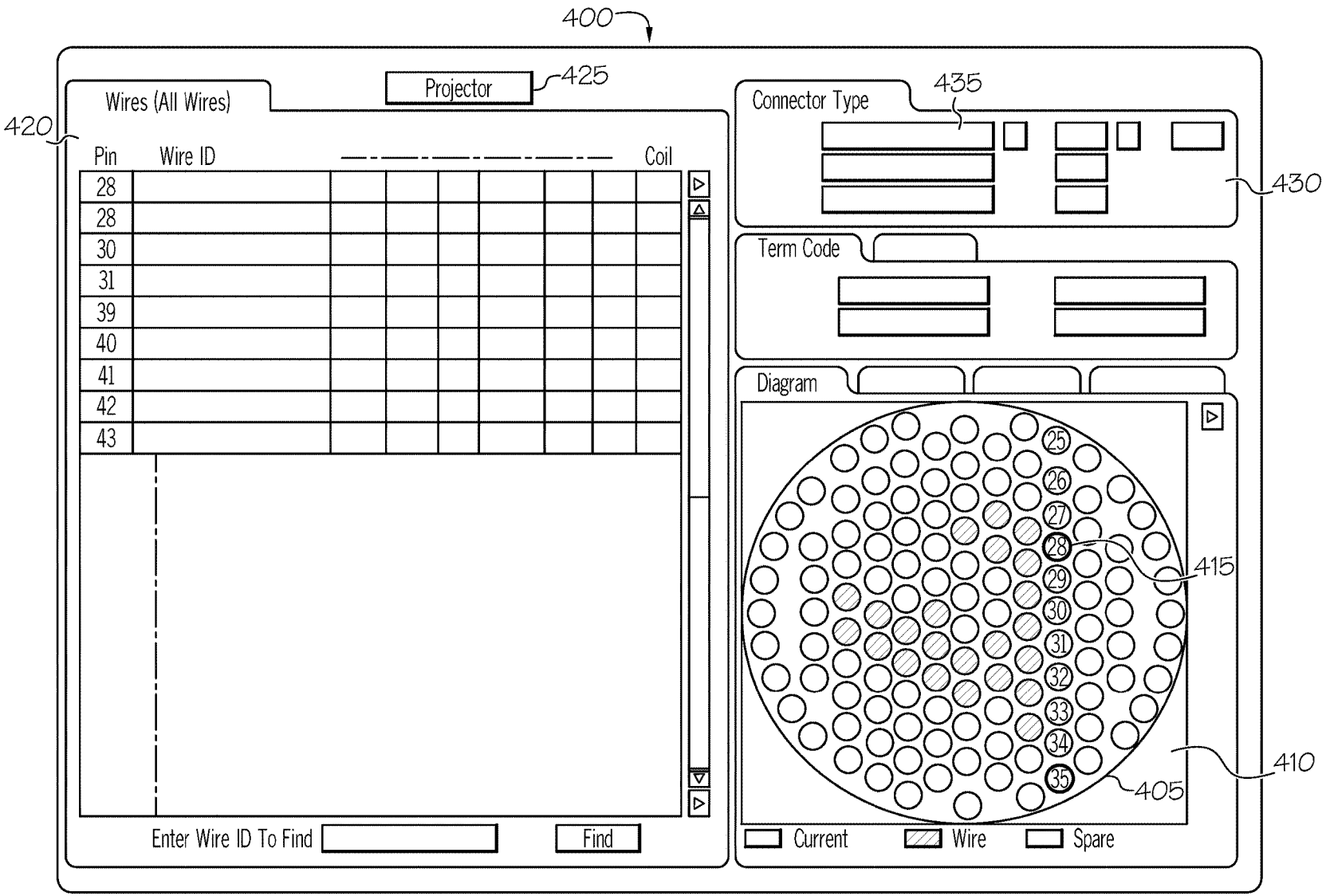
FIG. 6 depicts an exemplary graphical user interface in accordance with another embodiment of the present disclosure.

In this regard, FIG. 6 depicts an exemplary graphical user interface (GUI) 400 that may be provided by the wire insertion application to a display connected to the personal computing device 224 and/or to the server 202. The user may use this GUI 400 to select the connector schematic corresponding to the connector 120. A diagram 405 of the selected schematic may be displayed in a field 410. Specific wire information may be presented in the field 420 along with the specific wire cavity or pin location of the connector 120 with which the wire is associated. One or more pin locations (e.g., wire cavities) 415 may be highlighted in the diagram 405. The highlighted pin locations 415 may correspond to (i) one or more pin locations selected in the field 420, (ii) alignment pin locations as explained below, and/or (iii) illuminated pin locations as explained below. A projector button 425 may allow the user to initialize the projector 140. The GUI 400 may include a field 430 for inputting into one or more subfields 435 specific information about the connector 120.

Once the connector 120 has been secured to the wire insertion apparatus and the corresponding connector schematic has been selected, the wire insertion application of the personal computing device 224 and/or to the server 202 determines the orientation and position of the connector 120. The projector 140 is configured to project alignment dots onto the connector 120 for use in aligning the connector (to establish the position and orientation of the connector), and may be configured to illuminate one or more pin locations of the connector 120 based on the position and orientation of the connector 120. At block 315, the personal computing device 224 and/or to the server 202 cause the projector 140 to project at least two alignment dots (e.g., onto the connector 120). These alignment dots may have different sizes, shapes, colors, and/or other distinguishing characteristics, which may be customized by the user, to allow the user to differentiate between different alignment dots being concurrently projected. In addition, the wire insertion application will typically display to the user (e.g., via the GUI 400 on a computer monitor of the personal computing device 224 and/or to the server 202) information regarding an alignment pin location (e.g., wire cavity) of the connector 120 to which each of the alignment dots should be aligned (e.g., a first pin location to which a first alignment dot should be aligned and a second pin location to which a second alignment dot should be aligned). These alignment pin locations may be highlighted in the GUI 400. The alignment pin locations may be defined in the connector schematic or may be selected by the wire insertion application based on one or more rules. Typically, the alignment pin locations are on opposite sides of the connector 120 (e.g., a first alignment pin location on the far right side of the connector and a second alignment pin location on the far left side of the connector).

At block 320, the alignment dots may be moved by the user. In this regard, the wire insertion application may receive user inputs indicating that the location of one or more of the alignment dots should be moved (e.g., because the alignment dots are not projected on the alignment pin locations). Based on this user input, the wire insertion application may then move the location of the alignment dots being projected by the projector 140. The user will then continue to move the alignment dots until the alignment dots are aligned over the alignment pin locations. Typically, each alignment dot is moved independently by the user.

Figure 7:
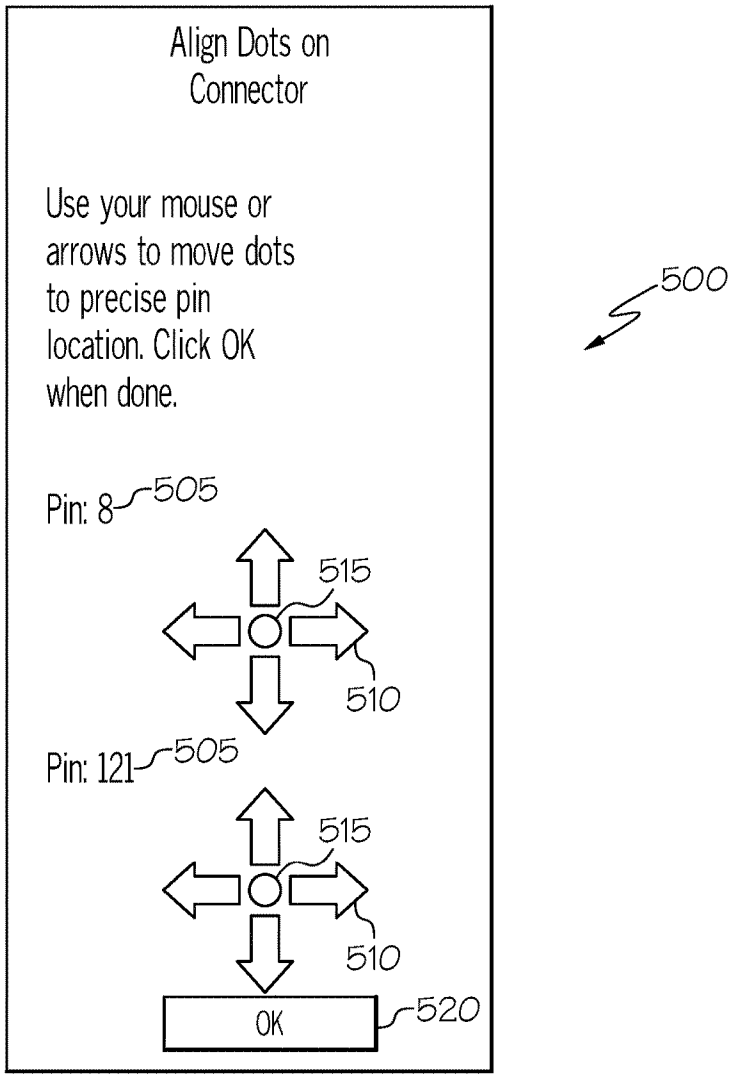
FIG. 7 depicts a second graphical user interface projected on a flat surface of a wire insertion apparatus in accordance with an embodiment of the present disclosure.

In this regard, FIG. 7 depicts a second graphical user interface (GUI) 500, which the wire insertion application may cause to be projected by the projector 140 for display on a flat surface of the wire insertion apparatus, which typically is adjacent to the connector 120. The projector 140 is configured to project alignment dots onto the connector (120) for alignment of the connector (120), and may be further configured to project graphical information about the alignment dots and one or more pin locations onto a flat surface adjacent to the connector. This second graphical user interface 500 may include information about the alignment dots and/or alignment pin locations, such as the identity of the alignment pin locations 505 and the color and/or shape of the alignment dots (e.g., an icon 515 that represents the color and/or shape of the alignment dots). The second graphical user interface 500 may also be configured to project graphical instructions for moving the alignment dots and to allow the user to control the movement of the alignment dots. For example, as depicted in FIG. 7, the second graphical user interface 500 may include buttons and/or icons 510 with which the user may interact to control the movement of the alignment dots (e.g., via a mouse, keyboard, or other interface device connected to the personal computing device 224 and/or to the server 202). By providing a second graphical user interface on the flat surface of the wire insertion apparatus in close proximity to the connector 120 being held by the wire insertion apparatus, the user can view information about the alignment dots and/or alignment pin locations and control the movement of the alignment pins without having to move the user's gaze away from the connector 120 towards another display (e.g., the graphical user interface 400).

At block 325, the wire insertion application determines alignment coordinates for the alignment dots, the alignment coordinates typically being the X-Y coordinates of the alignment dots, when the alignment dots are projected on the alignment pin locations. For example, once the alignment dots are positioned on the alignment pin locations, the wire insertion application may receive a user input indicating that the alignment dots are aligned over the alignment pin locations (e.g., based on the user pressing an appropriate button 520 the second graphical user interface 500). Based on this user input, the wire insertion application may then determine the X-Y coordinates of the alignment dots (e.g., the X-Y coordinates of the alignment dots relative to the graphical information being projected by the projector 140). In other words, the position and orientation of the connector is calibrated based on the coordinates of the alignment dots.

At block 330, the wire insertion application typically determines the position and orientation of the connector 120. The position and orientation of the connector 120 is typically determined based on (i) the alignment coordinates for the alignment dots, which represents the locations of the alignment pins, and (ii) the schematic for the connector 120. By determining the correct X-Y coordinates for at least two alignment pins, the wire insertion application can determine both the position of the connector 120 and the orientation of the connector 120 (e.g., the extent to which the connector 120 is rotated clockwise or counterclockwise relative to the orientation of graphical information being projected by the projector 140).

Thereafter, at block 335, based on the determined position and orientation of the connector 120 and based on the connector's schematic, the wire insertion application may cause the projector 140 to illuminate one or more pin locations of the connector 120. In some embodiments, multiple pin locations (e.g., up to four pin locations) may be concurrently illuminated. Which pin locations are illuminated may be based on user input. For example, the user may use a graphical user interface (GUI) provided by the wire insertion application (e.g., the graphical user interface 400) to select one or more pin locations to illuminate. To illuminate one or more pin locations, the wire insertion application may cause the graphical information being projected by the projected 140 to include an illumination dot projected onto the coordinates of each pin location being oriented. Typically, the position (e.g., X-Y coordinates) of an illumination dot is based on the corresponding pin location (e.g., X-Y coordinates) as defined in the connector's schematic adjusted for the determined position and orientation of the connector. These illumination dots may have different sizes, shapes, colors, and/or other distinguishing characteristics to allow the user to easily distinguish different pin locations being concurrently illuminated. The wire insertion application may allow the user to customize the size, shape, and/or color of the illumination dots (e.g., via a graphical user interface (GUI) provided by the wire insertion application). The user may then insert an appropriate wire into the illuminated pin location(s). Block 335 may be repeated for each pin location into which the user should insert a wire.

Figure 8B:
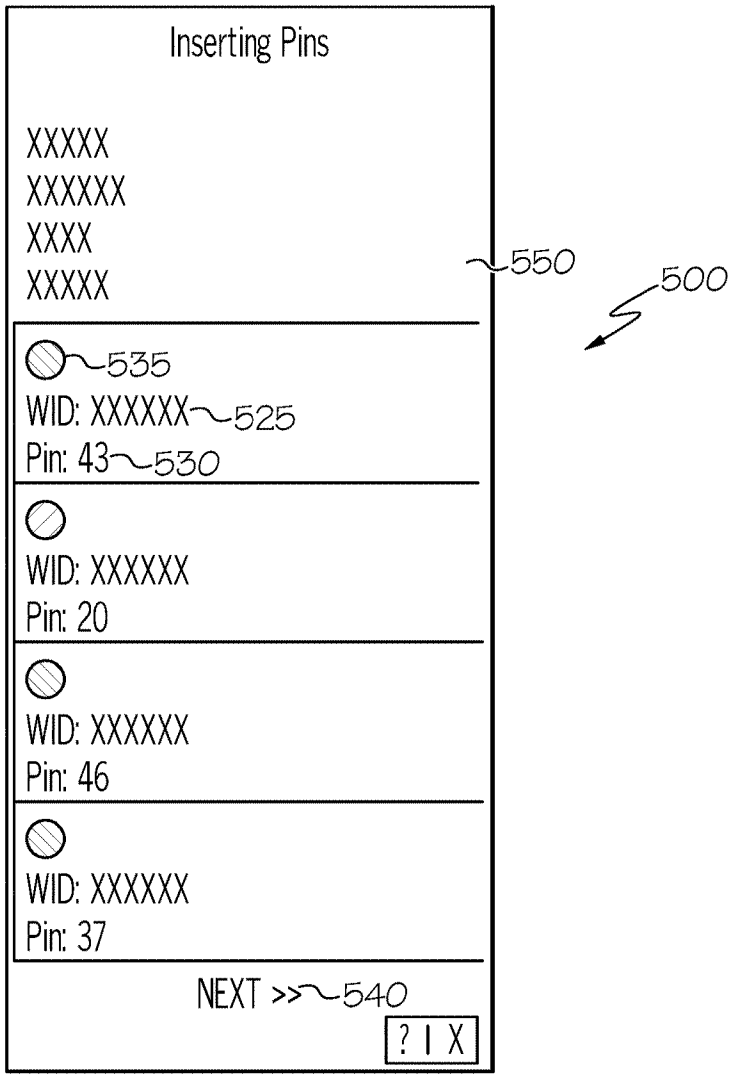
FIG. 8B depicts a second graphical user interface projected on a flat surface of a wire insertion apparatus in accordance with another embodiment of the present disclosure.
Figure 8A:
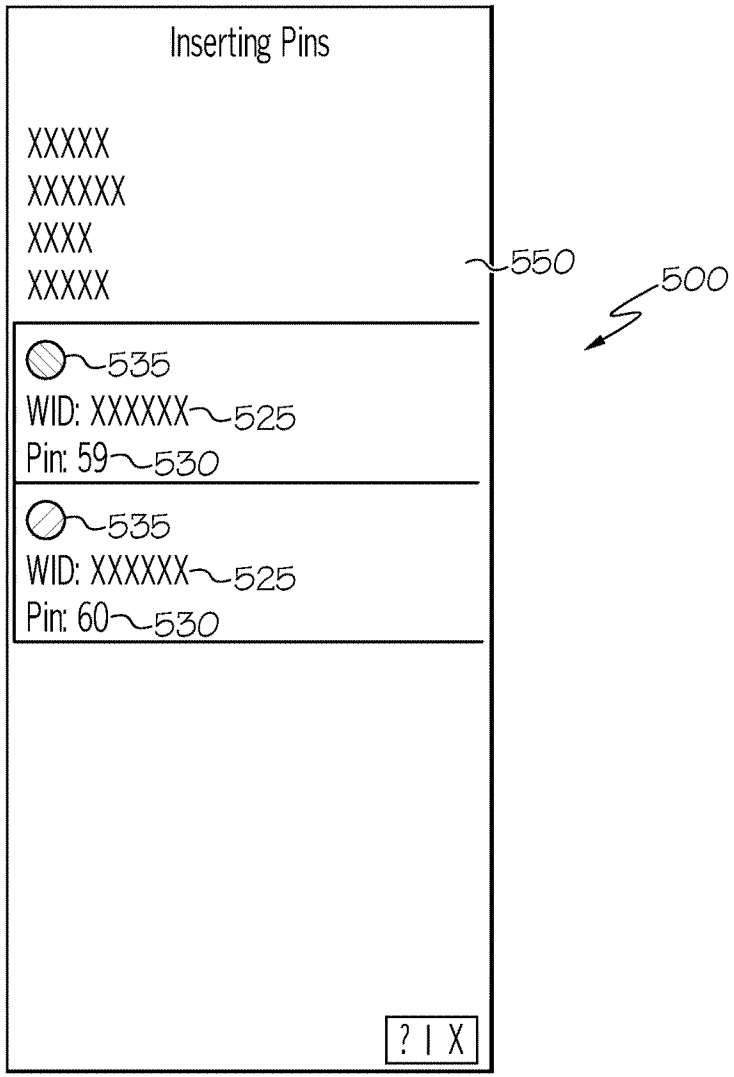
FIG. 8A depicts a second graphical user interface projected on a flat surface of a wire insertion apparatus in accordance with another embodiment of the present disclosure.

In some embodiments and as depicted in FIGS. 8A-8B, the wire insertion application may cause the second graphical user interface 500 projected on the flat surface of the wire insertion apparatus to include information about the pin locations and/or the wire(s) to be inserted, such as the identity 525 of the wire(s), the identity 525 of the pin locations, and the color and/or shape of the dot illuminating a particular pin location (e.g., an icon 535 that represents the color and/or shape of the dot illuminating a particular pin location). The second graphical user interface 500 may include a button 540 that allows the user to change for which pin locations information is being displayed. The second graphical user interface 500 may also include general information 550 about the connector and/or cable harness. Accordingly, the user can easily view information about the wires and pin locations without having to move the user's gaze away from the connector 120 towards another display.

In some instances, the user may desire to alter the orientation of the connector 120 (e.g., by rotating the connector 120) to facilitate the insertion of one or more wires. Accordingly, if the user changes the orientation of the connector 120, the steps described with respect to blocks 315-330 may be repeated. Once the wire insertion application determines the new position and orientation of the connector 120, one or more pin locations may be illuminated as described in block 335.

The system for assisting the assembly of a cable harness in accordance with the present disclosure allows the user to quickly and easily illuminate multiple pin locations in a connector to thereby allow the user to easily identify the cavity into which a wire should be inserted and without requiring the use of mechanically moving parts, which may breakdown or require adjustment. By employing illumination dots of different shapes and/or colors, the user can easily differentiate different pin locations being concurrently illuminated. In addition, the system in accordance with the present disclosure provides an intuitive way of easily determining the position and orientation of the connector so that pin locations subsequently can be accurately illuminated.

The flowchart and block diagrams in the Figures illustrate the architecture, functionality, and operation of possible implementations of apparatuses, systems, methods, and computer program products according to various embodiments of the present disclosure. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The terminology used herein is for the purpose of describing particular embodiments only and is not intended to be limiting of embodiments of the disclosure. As used herein, the singular forms "a", "an", and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Furthermore, when it is said herein that something is "based on" something else, it may be based on one or more other things as well. In other words, unless expressly indicated otherwise, as used herein "based on" means "based at least in part on" or "based at least partially on."

The corresponding structures, materials, acts, and equivalents of all means or step plus function elements in the claims below are intended to include any structure, material, or act for performing the function in combination with other claimed elements as specifically claimed. The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

Although specific embodiments have been illustrated and described herein, those of ordinary skill in the art appreciate that any arrangement which is calculated to achieve the same purpose may be substituted for the specific embodiments shown and that embodiments of the disclosure have other applications in other environments. This application is intended to cover any adaptations or variations of the present disclosure. The following claims are in no way intended to limit the scope of embodiments of the disclosure to the specific embodiments described herein.

What is claimed is:

1. A system (200) for assisting the assembly of a cable harness, comprising:

a wire insertion apparatus (100, 150), the wire insertion apparatus (100, 150) comprising:

a frame (105, 155), the frame (105) defining a connector mounting location (115, 165);

a projector mount (135, 185) attached to the frame (105, 155), the projector mount (135, 185) being positioned so that a projector (140) held in the projector mount (135, 185) projects graphical information onto a connector (120) held by the mounting location (115, 165); and the projector (140), the projector (140) being configured to project and move a plurality of alignment dots onto the connector (120) for use in aligning the connector (120) to establish the position and orientation of the connector, and configured to illuminate one or more pin locations of the connector (120) based on the position and orientation of the connector (120); and a computer device (202, 224) configured to: identify coordinates of the projected alignment dots on the connector (120), determine the position and orientation of the connector (120) based on the coordinates of the alignment dots, and control the projector (140) to illuminate the one or more pin locations of the connector (120) based on the position and orientation of the connector (120), wherein a wire is inserted into each of the one or more illuminated pin locations.

2. The system (200) according to claim 1, wherein the wire insertion apparatus (100, 150) comprises a clamp (125, 175) for releasably securing the connector (120) in the connector mounting location (115, 165).

3. The system (200) according to claim 1, wherein:

the frame (105, 155) defines a flat surface (130, 180) adjacent to the connector mounting location (115, 165); and the projector mount (135, 185) is positioned so that the projector (140) projects graphical information onto the flat surface (130, 180).

4. The system (200) according to claim 3, wherein the computer device (202, 224) is configured to control the projector (140) to project a graphical user interface (500) onto the flat surface (130, 180) on the frame (105, 155) adjacent to the connector mounting location (115, 165).

5. The system (200) according to claim 4, wherein the computer device (202, 224) is configured to control the projector (140) to move the alignment dots based on a user input received via the graphical user interface (500).

6. The system (200) according to claim 3, wherein illuminating one or more pin locations of the connector (120) comprises projecting graphical information regarding the one or more pin locations onto the flat surface (130, 180).

7. The system (200) according to claim 1, wherein the computer device (202, 224) is configured to:

receive a connector schematic (214, 241), the connector schematic (214, 241) defining coordinates for the one or more pin locations; and control the projector (140) to project an illumination dot onto each of the one or more pin locations based on (i) the position and orientation of the connector (120) and (ii) the coordinates for the one or more pin locations defined in the connector schematic (214, 241).

8. The system (200) according to claim 1, wherein the computer device (202, 224) is configured to control the projector (140) to concurrently project a plurality of illumination dots, each illumination dot being projected onto one of a plurality of pin locations of the connector (120), wherein each of the plurality of illumination dots has a distinguishing characteristic.

9. The system (200) according to claim 8, wherein the distinguishing characteristic of each of the plurality of illumination dots comprises at least one of a different size, shape and color.

10. The system according to claim 1, wherein:

the frame defines a flat surface adjacent to the connector mounting location;

the projector mount is positioned so that the projector projects graphical information onto the flat surface and the connector; and the computer device is configured to control the projector to control the graphical information projected on the flat surface and the connector.

11. The system according to claim 1, further comprising a wire insertion application executed by the computer device, wherein the wire insertion application is configured to allow a user to select a connector schematic corresponding to the connector.

12. The system according to claim 11, wherein the wire insertion application is configured to present the connector schematic in a graphical user interface on a display of the computer device.

13. The system according to claim 12, wherein the graphical user interface comprises a field comprising wire information and an associated wire cavities or pin locations of the connector for insertion of the wires.

14. The system according to claim 13, wherein one or more pin locations are highlighted on the connector schematic in the graphical user interface in response to corresponding pin locations being selected in the field comprising wire information and the associated wire cavities and pin locations.

15. The system according to claim 14, wherein the highlighted one or more pin locations on the connector schematic correspond to alignment pin locations or to one or more pin locations for insertion of associated wires.

16. The system according to claim 15, wherein the graphical user interface comprise a feature for activating the projector to project the alignment dots corresponding to the alignment pin locations or to illuminate the one or more pin locations for insertion of the associated wire.

17. The system according to claim 16, wherein each of alignment dots and each of the one or more pin locations for insertion of the associated wire comprise distinguishing characteristics.

18. The system according to claim 11, further comprising a graphical user interface configured to allow movement of alignment dots.

19. The system according to claim 1, further comprising a wire insertion application executed by the computer device, wherein the wire insertion application is configured to move a location of one or more of the alignment dots projected by the projector in response to one or more inputs from a user.

20. The system according to claim 19, wherein the wire insertion application is configured to present a graphical user interface comprising features to control movement of the alignment dots by the user.

21. A method of inserting wire(s) into a connector (120), comprising:

providing a wire insertion apparatus (100, 150), the wire insertion apparatus (100, 150) comprising:

a frame (105, 155), the frame (105) defining a connector mounting location (115, 165); and a projector mount (135, 185) attached to the frame (105, 155), the projector mount (135, 185) being positioned so that a projector (140) held in the projector mount (135, 185) projects graphical information onto the connector (120) when the connector (120) held by the mounting location (115, 165);

mounting the projector (140) to the projector mount, the projector (140) being configured to project and move a plurality of alignment dots onto the connector (120) for use in aligning the connector (120) to establish the position and orientation of the connector;

providing a computer device (202, 224) configured to: identify coordinates of the projected alignment dots on the connector (120), determine the position and orientation of the connector (120) based on the coordinates of the alignment dots, and control the projector (140) to illuminate one or more pin locations of the connector (120) based on the position and orientation of the connector (120);

mounting the connector (120) to the connector mounting location (115, 165);

projecting the plurality of alignment dots onto the connector (120);

moving the alignment dots projected onto the connector (120);

determining, via the computer device (202, 224), the position and orientation of the connector (120) based on the coordinates of the alignment dots;

controlling, via the computer device (202, 224), the projector (140) to illuminate the one or more pin locations of the connector (120) based on the position and orientation of the connector (120); and inserting a wire into each of the one or more illuminated pin locations.

22. The method according to claim 21, wherein:

the frame (105, 155) defines a flat surface (130, 180) adjacent to the connector mounting location (115, 165); and the projector mount (135, 185) is positioned so that the projector (140) projects graphical information onto the flat surface (130, 180).

23. The method according to claim 22, comprising controlling, via the computer device (202, 224), the projector (140) to project a graphical user interface (500) onto the flat surface (130, 180).

24. The method according to claim 21, comprising receiving a connector schematic (214, 241), the connector schematic (214, 241) defining coordinates for the one or more pin locations;

wherein illuminating the one or more pin locations of the connector (120) comprises controlling, via the computer device (202, 224), the projector (140) to project an illumination dot onto each of the one or more pin locations based on (i) the position and orientation of the connector (120) and (ii) the coordinates for the one or more pin locations defined in the connector schematic (214, 241).

25. The method according to claim 21, wherein illuminating the one or more pin locations of the connector (120) comprises controlling, via the computer device (202, 224), the projector (140) to concurrently project a plurality of illumination dots, each illumination dot being projected onto one of a plurality of pin locations of the connector (120).

* * * * *